United States Patent [19]

Sartor

[11] 4,243,112

[45] Jan. 6, 1981

[54] VIBRATOR-ASSISTED WELL AND MINERAL EXPLORATORY DRILLING, AND DRILLING APPARATUS

[76] Inventor: Ernest R. Sartor, 1665 Braeburn Rd., Altadena, Calif. 91101

[21] Appl. No.: 13,919

[22] Filed: Feb. 22, 1979

[51] Int. Cl.[3] ..... E21B 10/00

[52] U.S. Cl. ..... 175/55; 175/107; 175/329; 64/2 P; 285/118

[58] Field of Search ..... 64/2 P; 285/118, 223; 175/107, 55, 329, 330

[56] References Cited

U.S. PATENT DOCUMENTS

| | | | |
|---|---|---|---|
| 1,314,601 | 9/1919 | McCaskey | 64/2 P |
| 2,709,574 | 5/1955 | Artunoff | 175/107 |
| 2,743,083 | 4/1956 | Zublin | 175/107 |
| 3,135,124 | 6/1964 | Sartor et al. | 74/87 |
| 3,190,374 | 6/1965 | Caperan et al. | 285/118 |
| 3,285,349 | 11/1966 | Brandon | 175/55 |
| 3,709,308 | 1/1973 | Rowley | 175/329 |
| 3,727,704 | 4/1973 | Abplanalp | 175/329 |
| 3,958,649 | 5/1976 | Bull et al. | 285/223 |
| 4,058,163 | 11/1977 | Yandell | 175/55 |

*Primary Examiner*—William F. Pate, III
*Attorney, Agent, or Firm*—Donald D. Mon

[57] ABSTRACT

Well and exploratory drilling apparatus whose rotary motion is modified by a vibrator to provide lateral movement of its bit. There is also disclosed a universal movement which enables such action to occur in a steerable assembly, while providing a passage for a conduit to supply motive fluid to the vibrator, and isolating the drill rod from at least some of the vibrating forces.

21 Claims, 11 Drawing Figures

FIG. 4
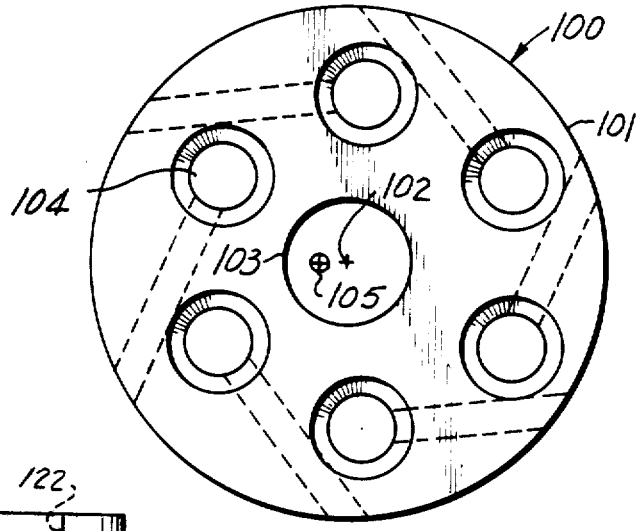
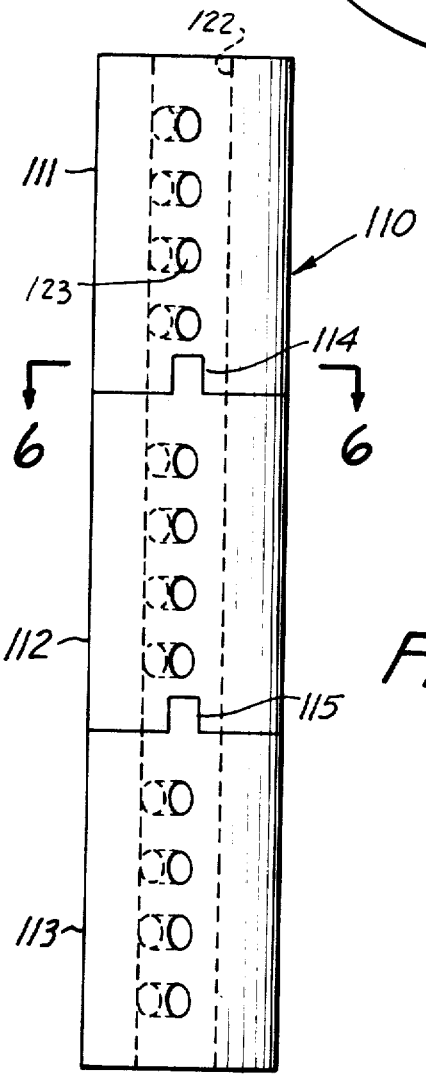
FIG. 5
FIG. 6
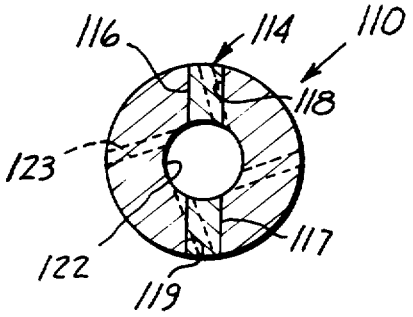

FIG. 7
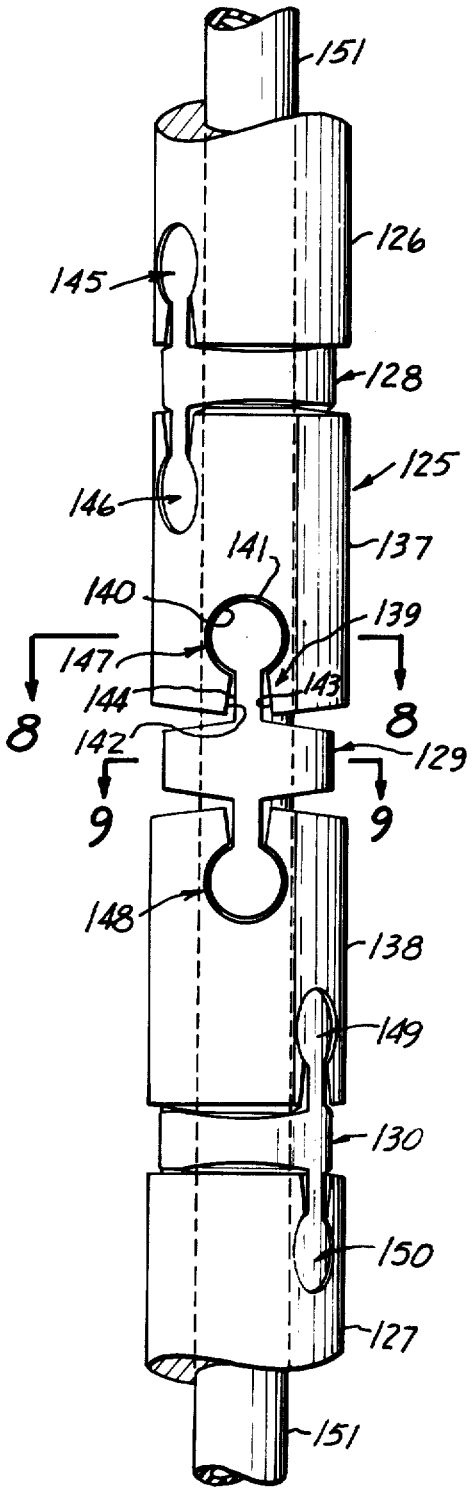
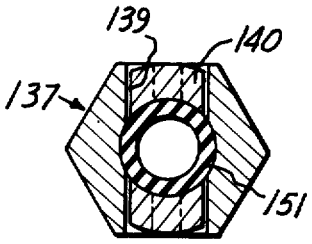
FIG. 8
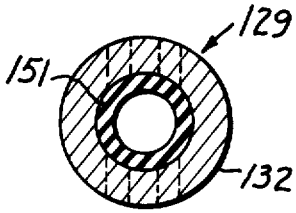
FIG. 9
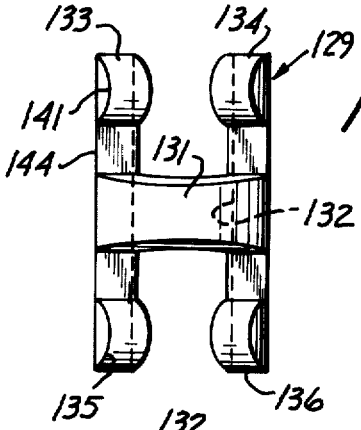
FIG. 10
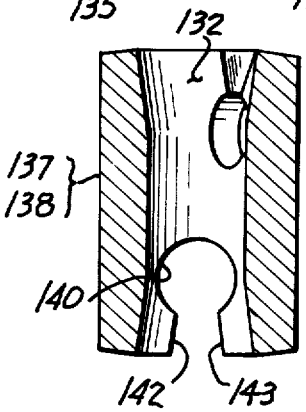
FIG. 11

VIBRATOR-ASSISTED WELL AND MINERAL EXPLORATORY DRILLING, AND DRILLING APPARATUS

This invention relates to the art of water well and mineral exploration, such as oil, gas, uranium, gold, silver, and iron ores.

The art of well drilling classically involves the rotating of a bit attached to the lower end of a drill stem or rod made from heavy steel tubing. The bit conventionally has either cutting rollers, or abrading or cutting surfaces. As the bit is rotated, it abrades away the material beneath it, and the detritus is transported to the surface by fluid means.

There is considerable room for improvement in the employment of rotary bits for well drilling. For example, if the bit cuts a hole only about equal to its own diameter, the wall of the hole will very often have to be lined with a steel casing material in order to prevent the hole from caving in. Also, the rate of penetration is limited by the cutting speed and thrust of the bit cutting edges relative to the material in which the bit is cutting, and by its total surface movement. An improved hole would be formed if it were possible for the bit not only to drill out but also to impact the inner wall as it passes, thereby somewhat enlarging the hole, and also packing the inner wall. In many wells this will eliminate the need for a casing. Furthermore, the cutting efficiency of the drilling bit can be increased if the motion of the cutting surfaces relative to the material to be removed are increased in both velocity and in total surface movement.

Furthermore, it is useful to be able to determine the direction of the drilling by controlling the speed and direction of rotation of the drill, but this often requires a universal joint in the drill rod, which conventionally prevents passage of a conduit to supply motive fluid to the vibrator, thereby depriving a vibrator-assisted drive of the advantage of "steering" with a universal-equipped drill rod.

It is an object of this invention to utilize a standard roller or diamond-abrading type bit, together with vibrator means which causes the bit itself to vibrate with at least a component of vibration in a plane lateral to the axis of the bore of the hole, and perhaps with some component of vibration acting vertically as well, whereby to increase the velocity and surface movement of the bit relative to the material being cut, and to enlarge and to treat the inner wall of the hole as it passes through it.

It is another object of this invention to provide such vibrator means so as substantially to eliminate maintenance on the vibrator during its excursion into the hole. This can be a profoundly important economic saving because it is costly in labor and down-time to pull out the drill string to repair the vibrator, and this invention results in fewer such "trips" being required.

It is yet another object of this invention to provide a vibrator which can utilize a compressible fluid for power, which fluid can be used to transport the detritus to the surface. If desired a hot fluid such as steam can be used which will also serve to heat the well area, such as petroleum and sulphur formations, especially in oil and gas wells.

An optional object of this invention is to provide differential means in the drill rod which enables motive fluid to be supplied to the vibrator means.

The invention is carried out in combination with a conventional drill bit of any desired type, and incorporates adjacent to or at least functionally near its cutting surfaces a vibrator which exerts circular orbiting vibrating forces with at least a component of that vibration in a plane normal to the axis of the bore of the hole.

According to a preferred feature of the invention, the vibrator is a vaneless rotor reaction type. This orbiting vibrator includes a free wheeling rotor driven by a compressible fluid, for example compressed air or stream.

According to a preferred but optional feature of the invention, the drill rod and bit are interconnected by a universal joint which passes a central fluid-conveying hose to the vibrator.

The above and other features of this invention will be fully understood from the following detailed description and the accompanying drawings, in which:

FIG. 4 is a plan view of another rotor suitable for use with the invention;

FIG. 5 is a side elevation of still another rotor useful with the invention;

FIG. 6 is a cross-section taken at line 6—6 in FIG. 5;

FIG. 7 is an elevation of a universal joint useful with the invention;

FIGS. 8 and 9 are cross-sections taken at lines 8—8 and 9—9 in FIG. 7;

FIG. 10 is an elevation of a part of FIG. 7; and

FIG. 11 is a cross-section taken at line 11—11 in FIG. 10.

Figure 1:
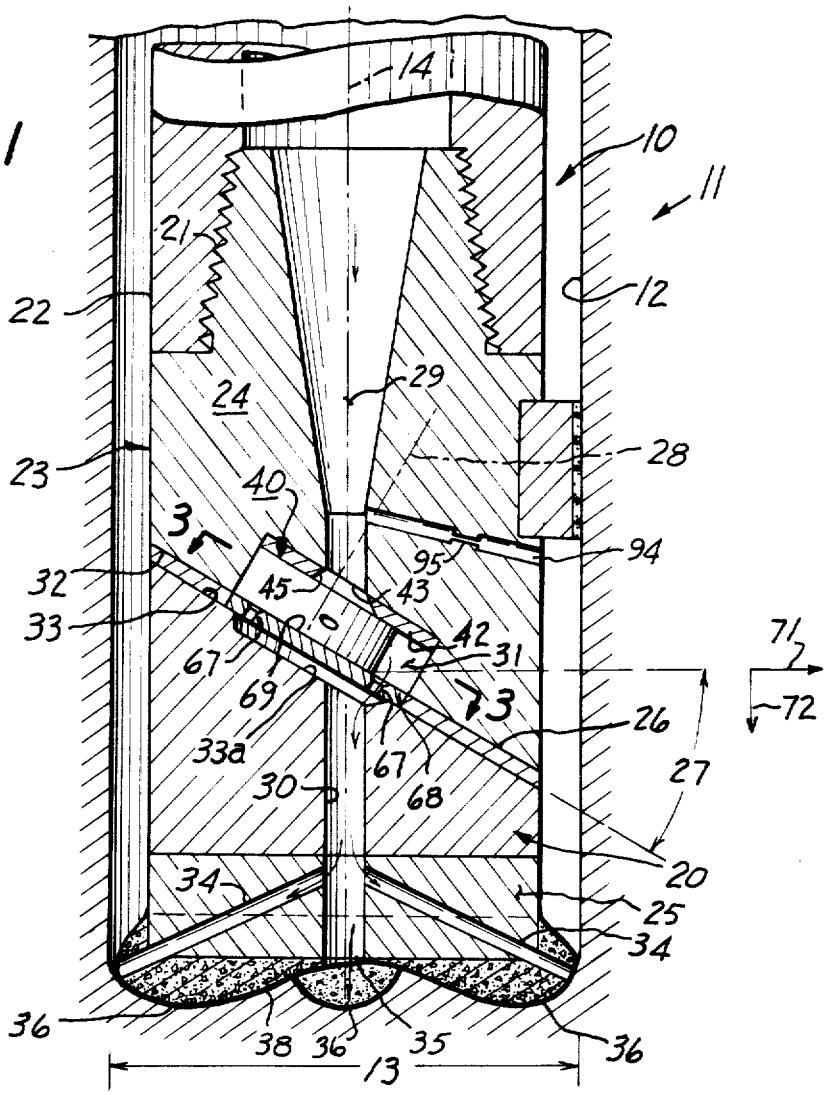
FIG. 1 is an axial cross-section showing the presently preferred embodiment of the invention.

In FIG. 1 there is shown a well shaft or bore 10 being drilled into the earth 11. The bore has a wall 12 with a diameter 13 and a longitudinal axis 14. It is in the process of being dug by a bit 20 of any conventional variety. This bit includes a tapered thread 21 by means of which it is attached to a drill rod 22 which is rotated by a torque exerted at the surface, and which also is forced into the earth for purposes of digging the well. This is a conventional technique.

The bit has a body 23 with a first body part 24 and a second body part 25. A spacer plate 26 is welded between them and joins them together. It is disposed at an angle 27 to the central axis 28 of the bit. Axis 28 is also the axis of rotation. A fluid passage 29 ("conduit means") extends axially through the first body part, and another fluid passage 30 ("conduit means") passes axially through the second body part. A vibrator chamber 31 is formed in bottom face 32 of the first part. A collector sink **33*a* is formed in the upper face 33 of the second body part. A plurality of branch passages 34 ("conduit") branch laterally from passage 30 near the bottom end. A central opening 35 from passage 30** is formed at the center of the bottom of the bit.

A plurality of cutting flutes 36 are formed at the bottom end of the bit. Recesses 37 are provided between them for clearance, and to receive the detritus. The flutes are faced with material such as industrial diamonds 38 or some other material which improves the abrading and cutting properties of the flutes. They are embedded in a matrix of tungsten carbide.

A vibrator 40 is placed in the vibrator chamber. This vibrator is preferably of the class shown in Sarter U.S. Pat. No. 3,135,124 issued June 2, 1964. It is a feature of this class of vibrator that it is a vaneless, rotary orbit jet reaction type. In this class of vibrator it is unnecessary to form individual expansion chambers around its periphery. Its operation is the consequence of jet reaction of pressurized fluid exhausting from jet orifices.

Figure 3:
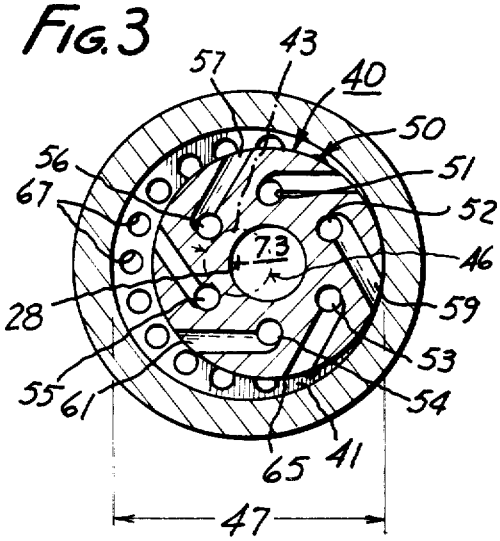
FIG. 3 is a cross-section taken at line 3—3 in FIG. 1.

FIG. 3 shows the vibrator in cross-section. The vibrator chamber has a cylindrical wall that forms a race 41. This race is capped by a flat cover plate 42 with an inlet port 43 on the central axis 28 of the vibrator. In FIG. 3, it is shown in phantom, because it lies above section 3—3, but this does disclose the proportion involved. The inlet port has a circular boundary 45 centered on axis 28. It has a diameter 46. The race has a diameter 47 that is larger than diameter 46.

A rotor 50 orbits around the central axis 44 in a way which will be understood from a study of said Sartor U.S. Pat. No. 3,135,124 which patent is incorporated herein by reference and made a part hereof. As can be seen by an examination of FIG. 2 a plurality of rotor inlet ports 51, 52, 53, 54, 55, 56 are drilled in the upper face of the rotor and extend by means of outlets 57, 58, 59, 60, 61 and 62 to the peripheral cylindrical wall 65 of the rotor where they depart at an oblique non-tangential non-radial direction from the wall, all in the same directional sense so as to propel the rotor in the face when motive fluid flows from them.

A plurality of exhaust ports 67 are provided for exhaust purposes. They pass through a base plate 68 having a bearing surface 69 and discharge into collector sink 33 which fluidly connects to fluid passage 30. There is a complete sequence of exhaust ports around axis 28, all at the same radius from axis 28.

The rotor makes a sliding, fluid sealing fit between surfaces 42 and 69.

It will now be seen that motive fluid is passed down the drill string to the inlet port 43 where it passes through and energizes the vibrator, out through an open exhaust port or ports, into and through the collector sink, and out the branch passages 34 (when provided) and central opening 35 (when provided).

It will be observed that this vibrator fits closely between cover plate 42 and bearing surface 69, and orbits around inside the race so as to exert an orbiting radial vibrator force sequentially in all radial directions. The plane of the vibrator lies in a plane normal to that of FIG. 1 and is disposed at angle 27 therewith, preferably between about 30° and 45°, although it can be at other angles instead. At least a component 71 of force is normal to the central axis of the bit. In the illustrated example, there is also a component 72 which is axial.

It is to be understood that, instead of being disposed at an angle this vibrator could be disposed normal to the central axis with its axis coincident therewith. The bit would then be provided only with lateral vibratory forces, and no axial forces. If its plane were parallel to the bit axis, there would be forces in all directions. It will also be understood that a plurality of vibrators could be provided, one or more normal, and one or more axial, or any combination thereof, including vibrators at different angles from one another.

When a well or shaft is drilled with the techniques of this invention, additional wall-treatment means are sometimes useful. For this purpose, a plurality of reamer strips 90 can be provided. Only one is shown, but they are advantageously provided in sets of three or four, spaced 120° or 90° apart from one another. They may be about 2 to 4 inches long and about ½ inch wide. Their outer surfaces 91 may project about ¼ inch from the outer wall of the body section in which they are implanted. These comprise a body 92 with a matrix 93 on the outer surface which is embedded with diamonds, the same as the bit. The side tamping and abrasion treatment given by these strips trims and further compacts the wall of the shaft.

As a further assistance in flushing detritus, especially at the reamer strips, a plurality of flushing ports 94 (only one is shown), extend from the central passage 29 to the outside of the body, through a fluid restrictor 95 which limits the rate of flow.

FIG. 4 shows a modified rotor which can be used with any embodiment of this invention. Rotor 100 is shown having an outer bearing surface 101 which is cylindrical and centered on center 102. It has a center passage 103 which also is centered on center 102. Its inlet ports 104 are formed on a circle whose center is off-set from center 102 and accordingly, if it is to the right of center 102, the centroid 105 of the rotor will be to the left of center 102. The off-center centroid causes a periodic variation in the orbital force, which adds a thumping effect to the orbital vibration effect. This can assist the wall-packing function.

FIG. 5 shows a means whereby a rotor system 110 can be made as long as desired. Frequently it will be desired to have a longer tubular rotor than can conveniently be manufactured in a single piece. The tolerances in this device are relatively close, and it is easier to manufacture the rotor in a plurality of shorter pieces than in a single long piece when it must be very long. For this purpose rotor sections 111, 112 and 113 are shown joined together by tongue and groove joints 114, 115, one of which is shown in detail FIG. 6. The other is identical. A pair of tongues 116, 117 fit in a pair of grooves 118, 119. Central pressure passage 120 is plugged at its bottom end by plug 121. Any desired number of these sections can be stacked up. Their central passage 122 is shown, together with a plurality of outlets 123 for reaction are also shown. Their operation is the same as in FIG. 1.

Because the vibrator exerts substantial lateral forces, it is possible to cause fatigue failures adjacent to the bit after a long period of time. This can be avoided by putting a flexural or bending means between the drill rod and the bit itself. This has the further advantage that if such flexibility exists, then using known techniques, the bit can be "steered" in the hole by coordinating the direction, axial force, and speed of twist of the drill rod. A universal joint is ideal for this situation, except that the conventional universal joint does not permit the passage of a hose or other member through it. The device shown in FIGS. 7–11 does permit this. In FIG. 7 there is shown a universal joint 125 connecting the drill rod 126 to the bit body 127. It has been found to be best practice to provide three axes of universal rotation at 120° apart for this class of operation. For this purpose, three keys 128, 129, 130 are provided. These are identical and only key 129 is shown in detail in FIG. 10.

Key 129 includes a central ring 131 with a central passage 132 passing therethrough. It includes four keys 133, 134, 135, 136 projecting axially therefrom in two sets diametrically across the ring. Keyways, all of which are identical are provided in the drill rod, drill body, and in two universal sections 137, 138.

Because the keyways are identical, only keyway 139 will be described in detail. It includes a circular section 140 to receive a dovetail 141 on the end of its key and clearances 142, 143 on each side of the stem on its respective key which provides for limited, about 7½°, rocking motion at this point. The central rings of the keys are appropriately sloped back to permit this relative movement. Sets 145, 146, 147, 148, 149 and 150 of keyways are provided to engage with respective keys. A hose 151 passes through the central passage of the universal joint to supply the vibrator.

Figure 2:
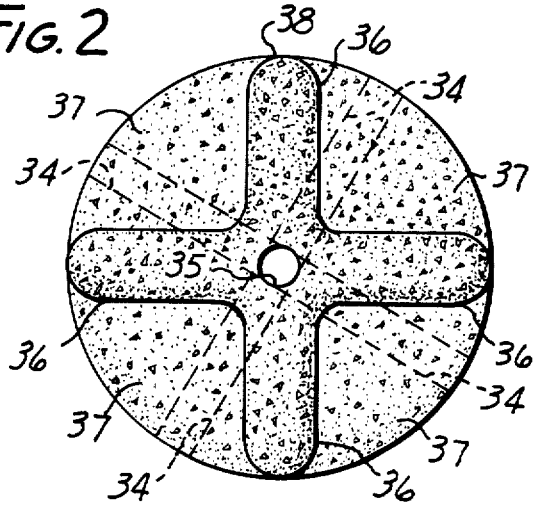
FIG. 2 is a bottom view of FIG. 1.

The operation of the various embodiments should be evident from the foregoing. In FIGS. 1–3, fluid under pressure appears at inlet port 43. Whichever one or ones of rotor inlet ports 51–56 is then registered with the inlet port will receive and pass the fluid, discharging it through its respective outlet which will exert a jet impulse force and start to roll the rotor. When the rotor bears against the race, at least one inlet port will always register with port 43. At the same time, one or more exhaust ports 67 will always be uncovered by the rotor and will pass the exhaust fluid. As the rotor rolls around inside the race, different ones of rotor inlet ports 51–56 will come into registration with the inlet port, and different ones of the outlet ports will be covered and uncovered. The result is a sequence of the above effects such that there will always be at least one outlet port discharging propulsive fluid and at least one exhaust port uncovered to exhaust it from the region between the race and the rotor. This is a well-known type of vibrator and further details of construction can be obtained from a reading of the Sartor patent. Suffice it to say that the dimensions of the inlet port, the inside diameter of the race, the outside diameter of the rotor, and the location and diameter sizes of the inlet ports, outlet ports and exhaust ports will be selected to achieve this purpose.

If desired, FIG. 2 can be scaled to obtain relative dimensions.

Central hole 73 through the rotor provides for some balance force at the bottom of the rotor. The rotor is customarily made of a bronze bearing metal, and the race of a hard steel. There is therefore minimal friction and wear. This device requires no lubrication and will work quite well when dry.

As to the propulsive fluid, air is a useful example and will suitably power the vibrator to exert its vibratory forces. It will also serve to flush and transport detritus up the hole even while the vibratory power of the vibrator causes the walls of the hole to be somewhat packed and therefore somewhat enlarged relative to the size of the bit. This makes the well or shaft wall more stable, and in some cases can save the cost of lining. Suffice it to say that the dimensions of the inlet port, the inside diameter of the race, the outside diameter of the rotor, and the location and diameter sizes of the inlet ports, outlet ports and exhaust ports will be selected to achieve this purpose.

If desired, FIG. 2 can be scaled to obtain relative dimensions.

Central hole 73 through the rotor provides for some balance force at the bottom of the rotor. The rotor is customarily made of a bronze bearing metal, and the race of a hard steel. There is therefore minimal friction and wer. This device requires no lubrication and will work quite well when dry.

As to the propulsive fluid, air is a useful example and will suitably power the vibrator to exert its vibratory forces. It will also serve to flush and transport detritus up the hole even while the vibratory power of the vibrator causes the walls of the hole to be somewhat packed and therefore somewhat enlarged relative to the size of the bit. This makes the well or shaft wall more stable, and in some cases can save the cost of a lining.

There are potential applications for this device wherein the motive fluid can be used for additional purposes such as for heating structures surrounding the hole. An example is an old oil formation, where the heat of live steam used as a propulsive fluid can melt previously solid material while the vibrator is exerting both an abrading and drilling action. Therefore when live steam is used in this device additional advantages may be obtained.

Conventional roller bits, which are so well known as to require no illustration may be used instead of the device shown. The typical Hughes roller bit is an example, wherein gear-like roller bits are mounted to a body and perform the drilling action.

The rotor of FIG. 4 can be directly substituted for rotor 40 in FIG. 1. Its operation is identical. However, because its centroid is off-center, perhaps by about ⅛ inches in a 2 inch diameter rotor, the result is that, when the centroid is closest to the race, the radial force will be greater than when it is farther from the race. Thus, an undulating, periodic effect is superimposed on the orbital force, and this "thumping" action can improve the wall treatment.

FIG. 5 requires no specific description of operation. Each of its sections functions like the rotor in FIGS. 1–3.

In FIGS. 7–11, the advantage is shown of providing flexible means such as a universal joint between the drill rod and the vibrator, especially in such a way that a hose can pass through the universal joint. The device shown has three, rather than two, pivot axes for the universal, and they are axially spaced apart. There results a long "bend" which is adaptable to the steering of a bit, and to the isolation of the drill rod from the vibrator itself.

Interestingly, when a hose such as hose 151 is used, and the vibrator exhaust ports communicate with the bore, suction can be applied to obtain gas and liquid samples from the bore.

This invention thereby provides elegantly simple means for increasing the efficiency of a drill bit whether of the roller, abrading, or cutting types. It increases the area over which the bit operates, can compact the wall of the hole and can operate for long periods of time without maintenence.

The vibrator is best mounted as close as possible to the abrading end of the bit, but need not be immediately adjacent thereto. It need only be operatively joined to it. The amount of force to be exerted by the vibrator depends on the mass of the bit and the type of formation being drilled. Persons skilled in the art will find no difficulty in making this selection. However, in a bit as shown weighing about 75 pounds, a rotor weighing about 14 pounds having an orbit velocity of about 3,500 to 6,000 orbits per minute, with an outer diameter of about 6 inches in a race with a diameter of about 6 inches in thickness which functions very well.

This invention is not to be limited by the embodiments shown in the drawings and described in the description which are given by way of example and not of limitation, but only in accordance with the scope of the appended claims.

I claim:

1. In combination:

a rotary drill bit having an axis of rotation, a body, cutting means carried by said body for cutting a hole when rotated and vibrated around said axis of rotation;

a free-orbiting vibrator having a case rigidly connected to said bit, said case having an internal race with a central axis, said vibrator having a freely orbiting, bearingless rotor inside said case adapted to roll around said race and thereby orbit therein, on a plane of vibration thereby exerting an orbiting lateral force having at least a component directed normal to said axis of rotation, said vibrator having a fluid inlet and a fluid outlet; and conduit means for receiving compressible motive fluid under pressure, supplying it to the vibrator, and exhausting it from said vibrator.

2. A combination according to claim 1 in which said cutting means comprises roller bits, for example tri-cone or four cone roller bits.

3. A combination according to claim 1 in which said cutting means comprises flutes or grooves.

4. A combination according to claim 3 in which said flutes are surfaced with diamonds or bortz.

5. A combination according to claim 1 in which said conduit means includes a discharge passage discharging near the cutting means and near the periphery of the bit.

6. A combination according to claim 1 in which said conduit means includes a passage extending laterally and discharging at the side of the bit.

7. A combination according to claim 1 in which said conduit means is coaxial with said axis of rotation, and discharging at the face of the bit.

8. A combination according to claim 1 in which the vibrator comprises a cylindrical rotor orbitally mounted in a race, said rotor and race having respective diameters and central axes, said central axes being parallel to one another.

9. A combination according to claim 8 in which said central axes are parallel to said axis of rotation.

10. A combination according to claim 9 in which said central axes make an angle with said axis of rotation.

11. A combination according to claim 9 in which said central axes are normal to said axis of rotation.

12. A combination according to claim 9 in which there are a plurality of said vibrators, the central axes of one vibrator being disposed at different angle relative to the axis of rotation than the other.

13. A combination according to claim 1 further including a universal joint assembly connected to the body of said drill bit and adapted to be connected to a rod for turning said assembly and bit, said universal joint assembly having three cross axes, disposed at 120° relative to one another.

14. A combination according to claim 13 in which a universal member comprising a ring and two opposed sets of keys and keyways is disposed at each said axis, and keyed to two adjacent, axially aligned members.

15. A combination according to claim 13 in which a central passage is formed through said universal joint assembly, and a hose is passed through said central passage.

16. A combination according to claim 14 in which a central passage is formed through said universal joint assembly, and a hose is passed through said central passage.

17. A combination according to claim 8 in which said rotor comprises a plurality of disc-like bodies keyed together for simultaneous rotation.

18. A combination according to claim 1 in which the drill bit body is provided with a plurality of sidewardly-facing and laterally-projecting diamond-surface reamer stripes.

19. A combination according to claim 18 in which said reamer strips are surfaced with diamonds or bortz.

20. A combination according to claim 18 in which a flushing conduit discharges fluid laterally from said body at an elevation beneath said reamer strip.

21. A combination according to claim 1 in which said conduit means exhausts said fluid adjacent to the cutting means.

* * * * *